US005400558A

United States Patent [19]

Hannah et al.

[11] Patent Number: 5,400,558

[45] Date of Patent: Mar. 28, 1995

[54] ROOFING SHINGLE SQUARE

[75] Inventors: Marcia G. Hannah, Wayne; George W. Mehrer, Jenkintown; Michael J. Noone, Wayne; Kermit E. Stahl, North Wales; Joseph Quaranta, Yardley, all of Pa.

[73] Assignee: CertainTeed Corporation, Valley Forge, Pa.

[21] Appl. No.: 93,789

[22] Filed: Jul. 19, 1993

Related U.S. Application Data

[60] Division of Ser. No. 682,611, Apr. 9, 1991, Pat. No. 5,287,661, which is a continuation-in-part of Ser. No. 515,601, Apr. 27, 1990, Pat. No. 5,181,361.

[51] Int. Cl.[6] ..... E04D 1/12

[52] U.S. Cl. ..... 52/559; 52/557; 52/555; 52/518

[58] Field of Search ..... 52/518, 555, 557, 559, 52/525

[56] References Cited

U.S. PATENT DOCUMENTS

| | | | |
|---|---|---|---|
| 1,585,692 | 5/1926 | Robinson | 52/559 |
| 1,612,776 | 12/1926 | Kirschbraun | 52/559 |
| 1,767,374 | 6/1930 | Kirschbraun | 52/557 X |
| 1,911,014 | 5/1933 | Cowan | 52/539 X |
| 2,012,709 | 8/1935 | Cowan | 52/555 |
| 2,161,440 | 6/1939 | Venrick | 52/555 |
| 2,178,273 | 10/1939 | Wiltenberg | 52/559 |
| 3,407,557 | 10/1968 | Shaw | 52/555 |
| 3,484,267 | 12/1969 | Sadler | 52/518 |
| 4,541,217 | 9/1985 | Stewart | 52/518 |
| 5,181,361 | 1/1993 | Hannah et al. | 52/535 |
| 5,239,802 | 8/1993 | Robinson | 52/518 |

*Primary Examiner*—Carl D. Friedman
*Assistant Examiner*—Robert J. Canfield
*Attorney, Agent, or Firm*—Paul & Paul

[57] ABSTRACT

A roofing shingle is provided for shingling a roof with overlapped shingles, wherein the exposed portion of the shingle is selected to be of a height in the installed condition relative to the overall height of the shingle that enhances material utilization, to be at least approximately 44.4% efficient. This is accomplished by using an exposure height of 8 inches relative to an overall shingle height of 18 inches. The shingles are preferably constructed to have either 3 or 4 tabs, thereby having a ratio of exposure height to tab width of either 0.667 or 0.889, respectively. A larger exposure allows one to obtain 200 shingles for each 300 lineal feet of sheet shingle material, when the shingles have 18 inch overall height, and further allows an overall saving in the number of nails required to install a roof. The invention also contemplates variations in tab width within a given shingle and variations in number of tabs from about one to nine tabs in a given shingle.

4 Claims, 3 Drawing Sheets

ROOFING SHINGLE SQUARE

This is a division of application Ser. No. 07/682,611, filed Apr. 9, 1991, now U.S. Pat. No. 5,287,661, which is a continuation-in-part of application Ser. No. 515,601, filed Apr. 27, 1990, now U.S. Pat. No. 5,181,361.

BACKGROUND OF THE INVENTION

In the art of shingle manufacture, it has become commonplace to construct shingles from a base mat, generally having an asphaltic composition applied over the mat, following which granules are applied to the shingle, in various configurations. The art has developed such that the granule applications, shingle thicknesses, overlainments of shingle materials, etc. have simulated the appearance of shingles of natural roofing materials, such as slate or wood. Often, such natural roofing materials such as slate or wood have greater exposures than asphalt shingles.

Standard asphalt shingles have a five inch height exposure in the installed condition, and a tab width (as measured across the bottom of a shingle tab) of 12 inches. This gives an exposure height to width ratio of about 0.417, often appearing to be unnatural relative to slate or wood shingles.

Also, the ordinary 12 inch high shingle designed to have 5 inches of height exposure will allow the manufacture of 300 shingles each 36 inches in overall width by 12 inches in height, out of 300 linear feet of shingle membrane or rolled material, when manufactured on a 36" wide mat.

Additionally, these standard shingles of 12 inches in height having 5 inch exposure will ordinarily require 80 shingles per roofing square (100 square feet of roof area) installed, and will utilize 320 nails per square when three-tabbed shingles are installed, and 400 nails per square when four-tabbed shingles are installed.

THE PRESENT INVENTION

The present invention resides in shingles having a unique exposure height to overall height; namely 8 inches relative to 18 inches, which yields desirable natural-appearing effects, requires fewer nails per square of roofing material, requires the installation of fewer shingles per square of roofing material, can result in material savings, and allows for the ready manufacture of shingles from sheets of shingle material that are originally 36 inches wide.

Accordingly, it is a primary object of this invention to provide a novel shingle.

It is another object of this invention to provide a shingle having an 8 inch height exposure.

It is a further object of this invention to provide a novel shingle having 8 inches of height exposure out of a total shingle height of 18 inches.

It is a further object of this invention to accomplish the above objects wherein the shingles can be either three-tabbed or four-tabbed shingles.

It is another object of this invention to accomplish the above object, wherein the shingles have exposure height to tab width ratios of 0.667 and 0.889, respectively.

It is another object of this invention to provide shingles in accordance with the above objects, wherein the shingles have a material utilization efficiency of approximately 44.4 percent.

It is another object of this invention to provide shingles having 8 inch exposure, but wherein the ratio of tab height to width can vary from about 8/36 to 8/4.

It is a further object of this invention to provide shingles having 8 inch tab height exposure, wherein the tab widths can vary in a given shingle.

It is a further object of this invention to accomplish the above objects wherein considerable variation may be provided in the number of single tabs, generally within the range of 1–9 tabs per shingle.

Another object of this invention is to provide shingles that may be installed on a roof at a substantial saving in the number of nails necessary to apply the shingles.

It is a further object of this invention to provide shingles that may be efficiently manufactured, and which will yield fewer, but larger shingles per square of installed roofing.

Other objects of this invention reside in providing a process for roofing with shingles, a method of producing shingles, and a novel shingled roof assembly, in accordance with any or all of the objects discussed above.

Other objects of the invention will be readily apparent upon a reading of the following brief descriptions of the drawing figures, detailed descriptions of the preferred embodiments, and the appended claims.

BRIEF DESCRIPTIONS OF THE DRAWING FIGURES

DETAILED DESCRIPTION OF THE PREFERRED EMBODIMENT

Figure 1:
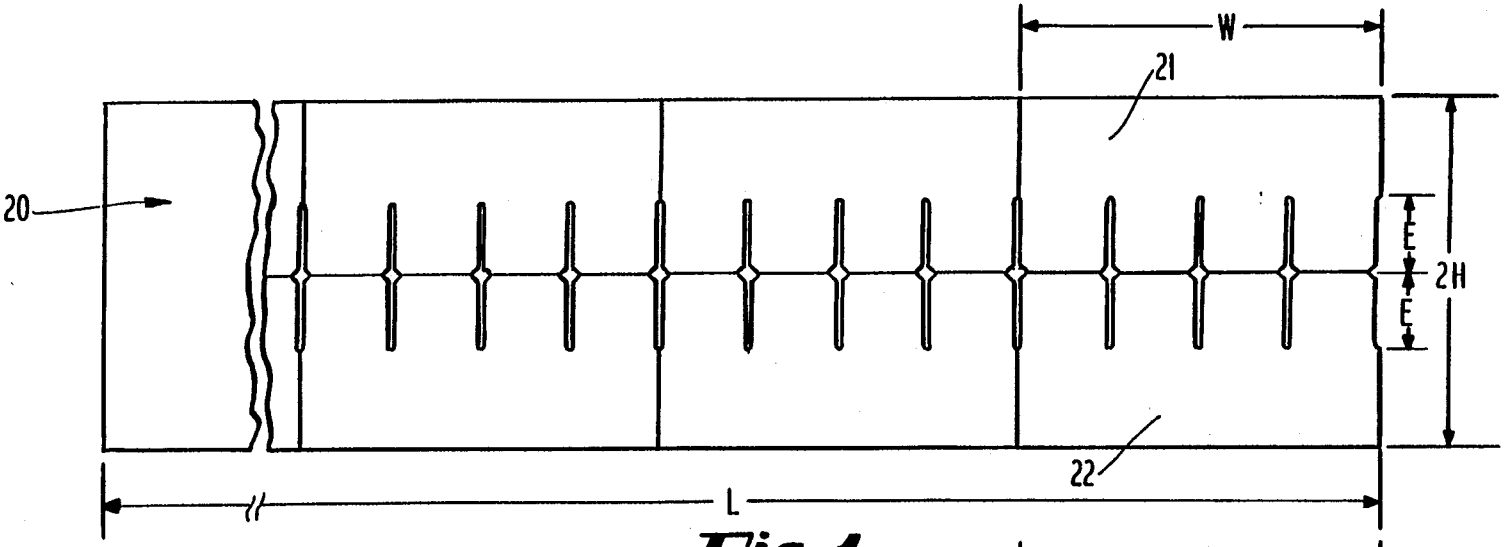
FIG. 1 is a fragmentary plan view of a sheet of shingle material having a plurality of shingles cut therefrom in pairs, wherein the shingles are four-tab shingles.

Referring now to the drawings in detail, reference is first made to FIG. 1, wherein a sheet 20 of roofing material is provided, nominally having a length "L" of 300 feet, and a width 2H of 36 inches, from which adjacent pairs of four-tab shingles 21, 22 may be cut, each of a height "H" of 18 inches, with each shingle being generally of an overall width "w" measured across its tabs of 36 inches.

Figure 3:
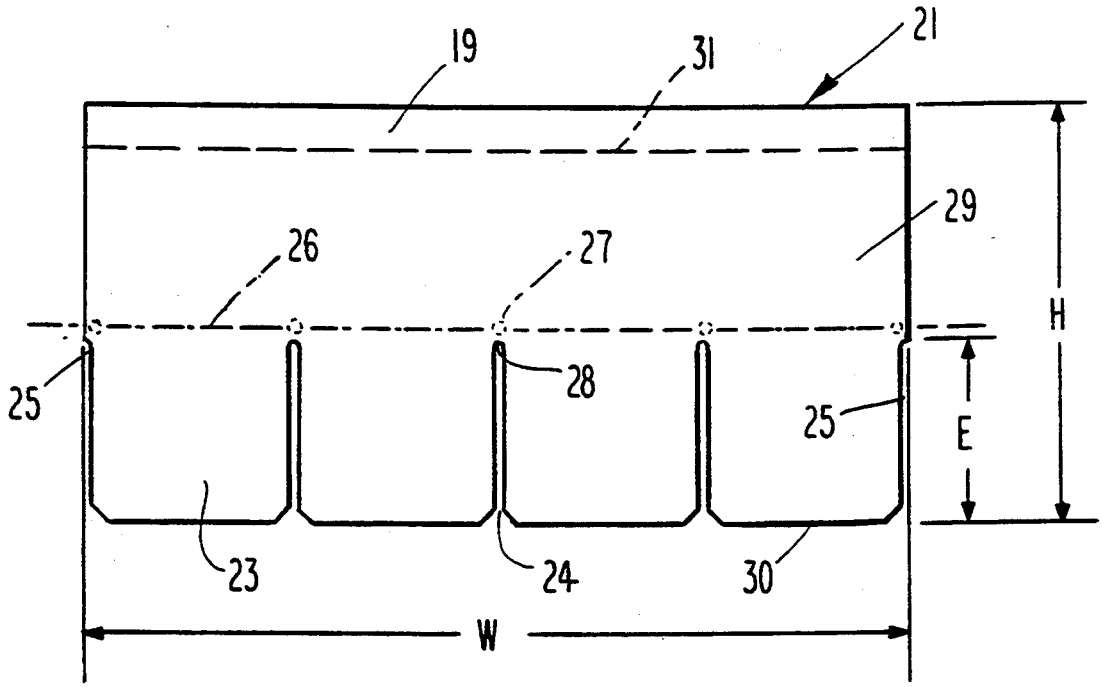
FIG. 3 is a top plan view of a four-tab shingle cut from the sheet of FIG. 1, and wherein five nailing zones are illustrated.

With reference to FIG. 3, it will be seen that each shingle 21 has four tabs 23, separated by slots 24 between the tabs, and having cut-out portions 25 at the ends of end tabs, each cut-out portion being approximately half the width of each slot 24, and of essentially the same height.

Above the slots 24 and cut-out portions 25, there is an imaginary line 26, along which are located 5 nailing zones 27 for the four-tab shingle. The nailing zones are generally in line above the slots 24 and cut-out portions 25. From approximately the upper ends 28 of the slots and cut-out portions, to the lower edges 30 of the tabs, there are located the exposure portions of the tabs, having exposure height "E" of 8 inches.

Figure 2:
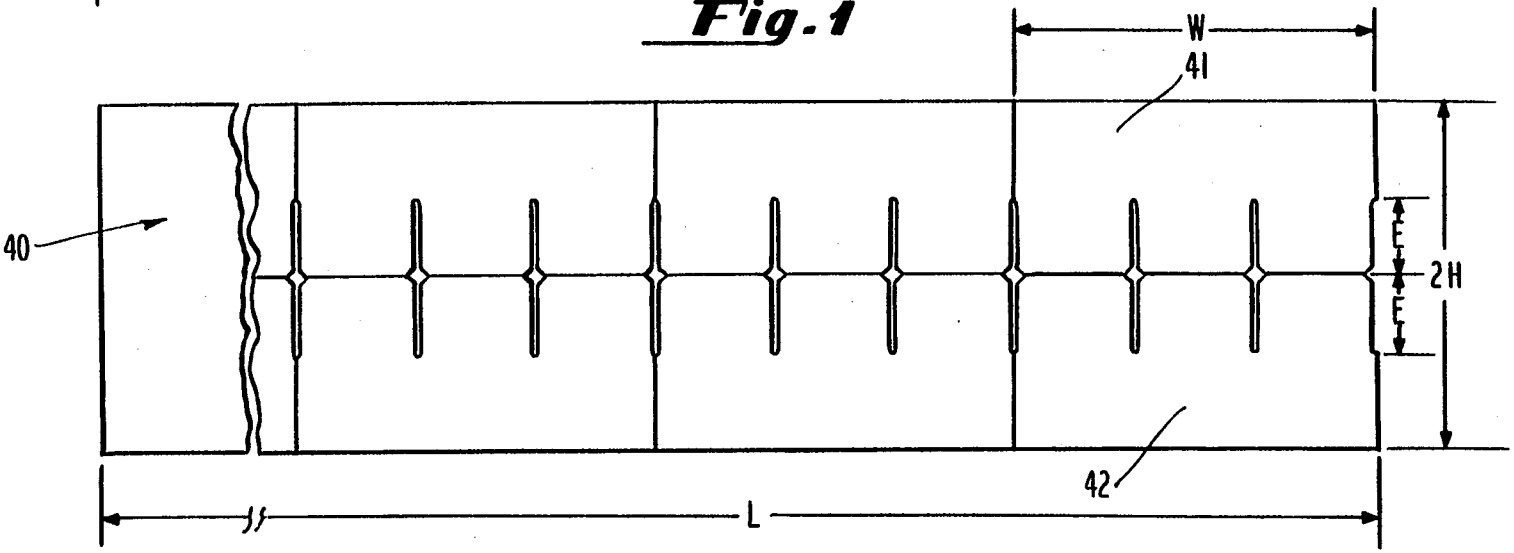
FIG. 2 is a fragmentary plan view of a sheet of shingle material having a plurality of shingle cut therefrom in pairs, wherein the shingles are three-tab shingles.

Similarly, with reference to FIG. 2, it will be seen that a sheet 40 provides adjacent three-tab shingles 41 and 42, each also of 18 inch overall height "H", for an aggregate height in FIG. 2 of 36 inches which corresponds with the width of the sheet 40.

Figure 4:
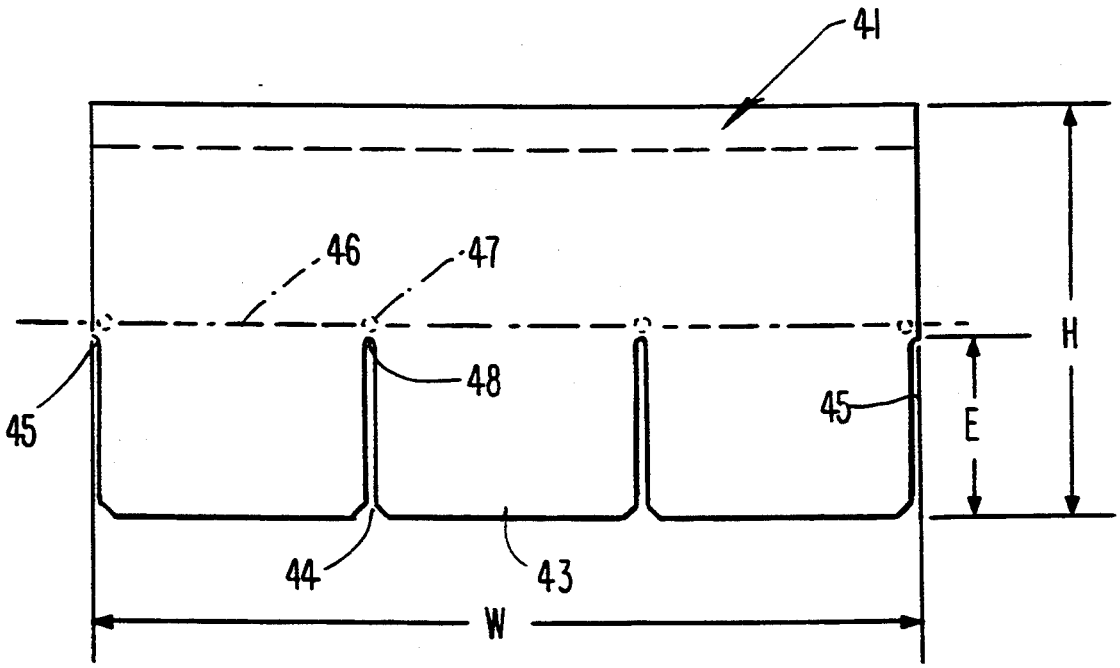
FIG. 4 is a top plan view of a three-tab shingle cut from the sheet of FIG. 2, and wherein four nailing zones are illustrated.

With reference to FIG. 4, a three-tab shingle 41 is illustrated, with the tabs 43 separated by slots 44 and with cut-out portions 45 being provided at the ends, similar to those 25 in FIG. 3. Nailing zones 47 are likewise provided, four in number for a three-tab shingle, along an imaginary line 46. The shingle of FIG. 4 likewise has an exposure height "E" of 8 inches relative to a total shingle height "H" of 18 inches.

Figure 5:
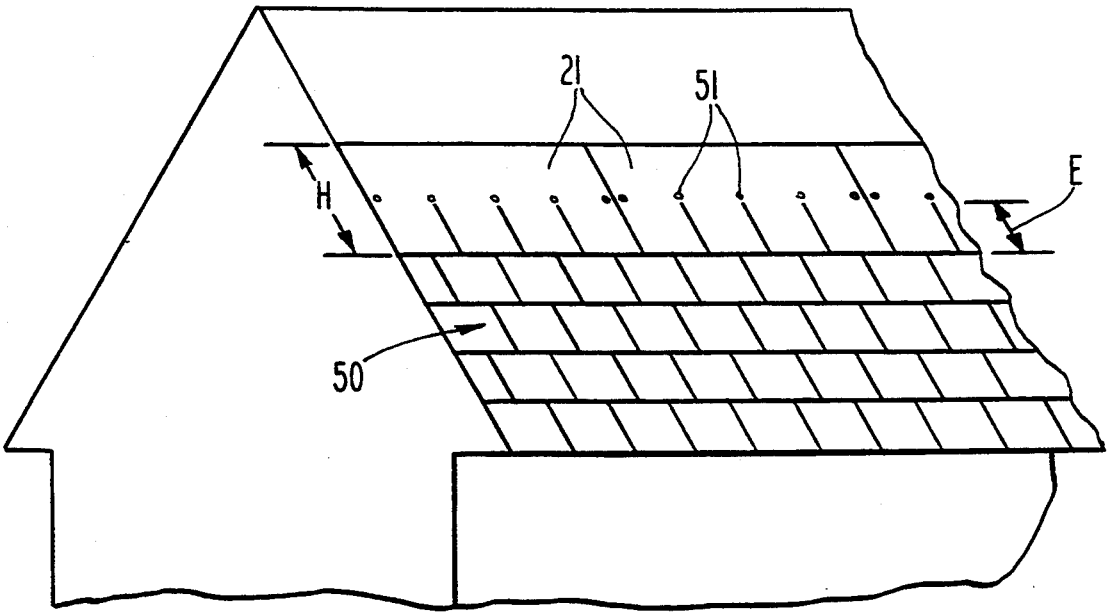
FIG. 5 is a fragmentary perspective view of an assembly of shingles on a roof, in accordance with this invention.

With specific reference to FIG. 5, a shingled roof assembly 50 is illustrated, being built up of a plurality of four-tab shingles 21 applied in courses running across the roof, with shingles having their tab areas exposed and covering top areas of shingles in next-lower courses, as shown, with nails 51 applied in the nailing zones 27, 47, as discussed above.

Figure 6:
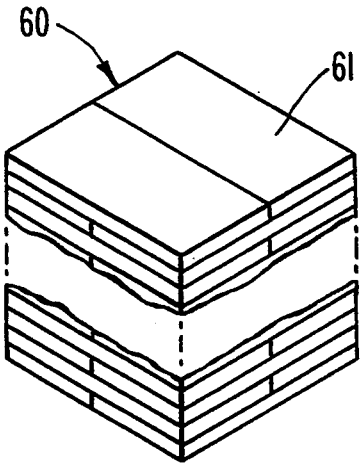
FIG. 6 is a top perspective view of bundles of shingles arranged in layers to form a stack of substantially square outlines and varying heights.

With specific reference to FIG. 6, it will be seen that a plurality of shingle bundles 61, either three-tab shingles or four-tab shingles 21 or 41 are provided in a stack 60. Each bundle 61 might contain anywhere from 5 to 30 shingles each, of the type 21, 41, depending upon the finished shingle weight. Such bundles 61, each approximately 18 inches by nominally 36 inches, when stacked alternately (rotated 90 degrees in their own planes from previous and succeeding layers), as shown, can make a stable and efficient pallet load, using a standard 36 inch by 36 inch pallet. Other width shingles may provide desired visual effect, but not a stable and efficient pallet load.

With respect to the shingles discussed above, wherein the shingles are four-tab shingles of the type of FIG. 3, the width of each tab will be approximately 9 inches, such that when the ratio of exposure height to tab width is defined by the formula $$\frac{(n)\ 8\ \text{inches}}{W}$$

where n equals the number of tabs across the shingle width, and equals the nominal shingle width in inches of a shingle across all of its tabs, such ratio is approximately 0.889. A similar calculation for a three-tab shingle yields a ratio of exposure height to tab width of approximately 0.667. It will be understood that the term "nominal shingle width" allows for cutting away with no material or some material between tabs. Thus, if no material is cut away, the nominal shingle width for a 4 tab shingle with each tab 9 inches wide, equals 36 inches. If each pair of adjacent tabs are separated by approximately $\frac{3}{8}$ inch width cutout, the actual aggregate material width across 4 tabs equals $34\frac{1}{2}$ inches, but the nominal shingle width remains 36 inches. The cutout width can, of course, vary from about zero to about 1 inch, but is usually in the $\frac{1}{4}$ inch to $\frac{3}{4}$ inch width range. The nominal shingle width does not vary.

It will also be noted that the 18 inch height "H" for the overall height of the shingles 21, 41, allows the construction of two side by side shingles simultaneously across the width of a given sheet of material 20, thereby efficiently using material from a 36 inch wide sheet, roll, or the like.

Each shingle in accordance with this invention will therefore have a top portion such as that 29 of FIG. 3, that is 10 inches in height, which allows for a two inch headlap portion 19 as shown in FIG. 3, above the imaginary line 31. A similar arrangement is present in FIG. 4, for the top portion and headlap portion of the shingle 41.

If material utilization efficiency is defined as the ratio of exposure to overall shingle height, then it will be seen that a shingle of 8 inch exposure relative to an overall shingle height of 18 inches will be approximately 44.4 percent efficient as compared with a customary shingle of 5 inch exposure and 12 inch overall height, which is only 41.7 percent efficient.

Also, shingles produced in accordance with the present invention, as aforesaid, will provide 200 shingles of the indicated size, as aforesaid, out of 300 linear feet of sheet material 20 or 40, rather than 300 shingles 36 inches by 12 inches high. The 200 shingles produced in accordance with the present invention are sufficient to cover 400 square feet of roof area, rather than a coverage of only 375 square feet of roof area from 300 conventional sized shingles. Accordingly, it will be noted that shingles made in accordance with the size arrangements set forth herein allow for material savings in producing approximately 6.7 percent more salable product per unit length of sheet.

It will also be apparent that a roofing square; namely 100 square feet of roof area, can be covered by 50 shingles in accordance with the present invention, rather than requiring 80 shingles in accordance with conventional sized shingles.

The shingles of the present invention also allow for using fewer nails, in that the nailing zones 27 or 47, will require only 250 nails per square of roof area for a four-tab shingle and only 200 nails per square of roof area for a three-tab shingle. This is compared with 400 nails per square of roof area and 320 nails per square of roof area for conventional shingles, of four-tabs and three-tabs, respectively for conventional Shingles that are 36 inches wide, but only 12 inches high, with 5 inches of exposure. The number (n+1) of nailing zones (such as is shown e.g. by the numerals 27 or 47) on a given shingle, depending upon the number (n) of tabs, with the number of tabs in a given shingle separated by a number (n−1) of slots, therefore yields 200 or 250 nailing zones in a square, for three-tab and four-tab shingles, respectively. The reduction of the number of nailing zones in applying shingles to a roof can be substantial, resulting in a considerable saving of the time and expense of applying nails, as well as the cost of nails saved, in that a typical thirty square roof would result in a saving of 2100 nails, in accordance with the present invention, when a roof is shingled with four-tab shingles of the present invention rather than standard three-tab prior art shingles. Moreover, if three-tab shingles of the present invention are used rather than three-tab standard prior art shingles, this results in a nail saving of 3600 nails; if four-tab shingles of the present invention are used rather than four-tab standard prior art shingles, the saving is 4500 nails.

Additional advantages reside in the present invention. For example, roofers typically line a roof with chalk for each alternate course (row) of shingles. Thus chalk lines can be made every 16 inches, corresponding to a double exposure. This 16 inch spacing also corresponds with conventional markings on tape measures used by roofers, which generally are highlighted every 16 inches to correspond to wall stud spacing for housing.

Additionally, single bundles of the present invention may readily be palletized, or stacked, as shown in FIG. 6. While the shingle bundles are stacked two to a layer, as shown, resulting in a stack that is 36 inches square, the height of the stack may vary.

It will be apparent from the foregoing that various modifications may be made in the details of construction of the shingle of the present invention, and/or of a shingled roof assembly made in accordance therewith, as well as in the process of manufacture, the arrangement of shingles on the roof, and the method of application of shingles. Modifications may be made in the stacking or palletizing of shingles in accordance with this invention, all within the spirit and scope of the invention as defined in the claims. It will further be apparent throughout this application that where dimensions, such as 8 inch, 36 inch, 18 inches, etc. are set forth as being of significance, that it is intended to encompass minor variations, such as will arise from manufacturing tolerances and the like. Thus, these dimensional limitations should be construed to encompass dimensions that are substantially the same, or about the same, but which would yield the same essential benefits in accordance with the present invention.

Additionally, the shingles can be constructed of multiple ply thicknesses, in whole or in part, for greater weather resistence and/or for diverse aesthetic effects.

What is claimed is:

1. A square of shingles, having 50 shingles, sufficient to cover 100 square feet of roof area when the shingles are disposed in a laid-up condition on a roof, with their tab areas exposed and covering top areas of shingles in a next-lower course, with each shingle in the square having a total shingle height of 18 inches with an exposed tab portion 8 inches in height, a tab exposure area and a top area, with the tab areas each including (n) number of tabs separated by (n−1) slots, with nailing zones being located near an end of each slot in the top area of the shingle above the slot and at each end of the shingle, with all nailing zones being generally along a common imaginary line to define (n+1) nailing zones; where n=any of the whole numbers 3 and 4 and where the number of nailing zones in the square equals 200 where n=3 and 250 where n=4.

2. The Square of claim 1, wherein said fifty Shingles are packaged in a plurality of bundles prior to installation, wherein the bundles of shingles are in stacked relation, two to a layer, defining a rectangular stack base of nominally 36 inch wide shingles, of approximately 36 inch square.

3. A square of shingles, having fifty shingles, sufficient to cover 100 square feet of roof area when the shingles are disposed in a laid-up condition on a roof, with their tab areas exposed and covering top areas of shingles in a next-lower course, with each shingle in the square having a total shingle height of 18 inches with an exposed tab portion 8 inches in height, a tab exposure area and a top area, wherein the shingles each have a width dimension and sufficient tab exposure area to comprise means whereby, in the laid-up condition on a roof, 50 shingles can cover the 100 square foot area.

4. The square of shingles of claim 3, with the tab areas each including (n) number of tabs separated by (n−1) slots, with nailing zones being located near an end of each slot in the top area of the shingle above the slot and at each end of the shingle, with all nailing zones being generally along a common imaginary line to define (n+1) nailing zones; where n=any of the whole numbers 3 and 4 and where the number of nailing zones in the square equals 200 where n=3 and 250 where n=4.

* * * * *

UNITED STATES PATENT AND TRADEMARK OFFICE

CERTIFICATE OF CORRECTION

PATENT NO. : 5,400,558
DATED : March 28, 1995
INVENTOR(S) : Marcia G. Hannah, George W. Mehrer, Michael J. Noone, Kermit E. Stahl & Joseph Quaranta It is certified that error appears in the above-indentified patent and that said Letters Patent is hereby corrected as shown below:

Col. 3, line 49, after "and" and before "equals" the letter --W-- should be inserted.

Signed and Sealed this

Tenth Day of October, 1995

*Attest:*

*Attesting Officer*

BRUCE LEHMAN

*Commissioner of Patents and Trademarks*